US008857914B2

(12) United States Patent
Adams et al.

(10) Patent No.: US 8,857,914 B2
(45) Date of Patent: Oct. 14, 2014

(54) SEAT FOR MOLDED PLASTIC CHAIRS

(75) Inventors: William E. Adams, Portersville, PA (US); Robert G. Schreiber, Prospect, PA (US)

(73) Assignee: Adams Mfg. Corp., Portersville, PA (US)

( * ) Notice: Subject to any disclaimer, the term of this patent is extended or adjusted under 35 U.S.C. 154(b) by 53 days.

(21) Appl. No.: 13/459,426

(22) Filed: Apr. 30, 2012

(65) Prior Publication Data

US 2013/0285432 A1 Oct. 31, 2013

(51) Int. Cl.

| | |
|---|---|
| ***A47C 7/14*** | (2006.01) |
| ***A47C 5/12*** | (2006.01) |
| ***A47C 9/00*** | (2006.01) |

(52) U.S. Cl.

USPC ..... 297/452.21; 297/451.11; 297/452.14; 297/452.22; 297/452.23; 297/452.24; 297/452.25; 297/461; 297/202

(58) Field of Classification Search

CPC ..... A47C 7/022; A47C 7/16; B62J 1/00
USPC ..... 297/202, 451.11, 452.14, 452.65, 297/452.21, 452.22, 452.23, 452.24, 297/452.25, 461

See application file for complete search history.

(56) References Cited

U.S. PATENT DOCUMENTS

| | | | | | |
|---|---|---|---|---|---|
| 2,199,479 | A * | 5/1940 | Cappel | 297/452.22 X |
| 2,970,638 | A * | 2/1961 | Halter | 297/452.25 |
| 3,138,404 | A * | 6/1964 | Newton | 297/452.24 X |
| 3,205,010 | A * | 9/1965 | Schick | 297/452.21 X |
| 3,376,070 | A * | 4/1968 | Johnson | 297/452.25 X |
| 3,503,649 | A * | 3/1970 | Johnson | 297/452.25 X |
| 3,511,537 | A * | 5/1970 | Ackermann | 297/452.21 |
| 4,552,404 | A * | 11/1985 | Congleton | 297/452.25 X |
| 4,564,240 | A * | 1/1986 | Thieme | 297/452.14 |
| 4,824,174 | A * | 4/1989 | Dunn, Sr. | 297/452.25 X |
| 5,163,737 | A * | 11/1992 | Navach et al. | 297/452.25 |
| 5,288,135 | A * | 2/1994 | Forcier et al. | 297/452.21 |
| 5,352,023 | A * | 10/1994 | Jay et al. | 297/452.21 |
| 5,387,024 | A * | 2/1995 | Bigolin | 297/202 |
| 5,522,106 | A * | 6/1996 | Harrison et al. | 297/452.25 X |
| 5,702,153 | A * | 12/1997 | Pliska | 297/452.22 X |
| 5,833,319 | A * | 11/1998 | Davis | 297/452.21 |
| 5,836,025 | A * | 11/1998 | Poncy, Sr. | 297/452.22 X |
| 5,887,951 | A * | 3/1999 | Willingham | 297/452.23 |
| 5,979,989 | A * | 11/1999 | Herbst | 297/452.22 |
| 6,139,098 | A * | 10/2000 | Carrillo | 297/202 |
| 6,142,573 | A * | 11/2000 | Harding et al. | 297/452.25 |
| 6,193,309 | B1 * | 2/2001 | Gootter et al. | 297/202 |
| 6,457,773 | B1 * | 10/2002 | Gates | 297/452.21 X |
| 6,669,283 | B2 * | 12/2003 | Yu | 297/202 X |
| 6,739,656 | B2 * | 5/2004 | Yu | 297/202 X |

(Continued)

*Primary Examiner* — Rodney B White
(74) *Attorney, Agent, or Firm* — Buchanan Ingersoll & Rooney PC

(57) ABSTRACT

A seat on a stool, chair or bench has a permanent depression in the surface of the seat that corresponds in shape to an end view of a human iliac bone. This shape has concave curved central channel which has a first end and a second end. There is a first concave boomerang shaped channel having a central portion connected to the first end of the concave curved central channel and a second concave boomerang shaped channel having a central portion connected to the second end of the concave curved central channel. A chair, stool or bench whose seat has such a permanent depression is more comfortable to the person sitting on that seat than hard seats on seating devices known in the art.

8 Claims, 6 Drawing Sheets

(56) References Cited

U.S. PATENT DOCUMENTS

| | | | | |
|---|---|---|---|---|
| 6,880,885 | B2 * | 4/2005 | Lan | 297/202 |
| 7,044,540 | B2 * | 5/2006 | Bigolin | 297/452.14 X |
| 7,055,900 | B2 * | 6/2006 | Losio et al. | 297/202 X |
| 7,059,674 | B2 * | 6/2006 | Garland et al. | 297/202 X |
| 7,083,229 | B2 * | 8/2006 | Cope | 297/452.24 X |
| 7,121,622 | B1 * | 10/2006 | Mendez | 297/202 X |
| 7,275,788 | B2 * | 10/2007 | Dettmann et al. | 297/451.11 X |
| D555,401 | S | 11/2007 | Adams | |
| D555,942 | S | 11/2007 | Adams | |
| 7,367,619 | B2 * | 5/2008 | Fregonese et al. | 297/202 X |
| 7,607,738 | B2 * | 10/2009 | Gregory et al. | 297/452.23 |
| 7,614,704 | B2 * | 11/2009 | Whelan et al. | 297/452.25 |
| 7,699,391 | B2 * | 4/2010 | Riondato | 297/202 |
| 7,891,033 | B2 * | 2/2011 | Loewenthal et al. | 297/452.21 X |
| 7,934,770 | B2 * | 5/2011 | Toll | 297/202 |
| 2002/0003364 | A1 * | 1/2002 | Minkow et al. | 297/202 |
| 2002/0175553 | A1 * | 11/2002 | Steifensand | 297/452.22 |
| 2003/0025364 | A1 * | 2/2003 | Antonio | 297/202 |
| 2005/0200187 | A1 * | 9/2005 | Vela-Cobos | 297/452.22 |
| 2005/0236875 | A1 * | 10/2005 | Milton | 297/202 |
| 2006/0076808 | A1 * | 4/2006 | Buchel | 297/202 X |
| 2007/0069557 | A1 * | 3/2007 | Toll | 297/202 |
| 2007/0176472 | A1 * | 8/2007 | Chuang | 297/202 |
| 2007/0210625 | A1 * | 9/2007 | Chen et al. | 297/202 |
| 2008/0265636 | A1 * | 10/2008 | Toll | 297/202 |
| 2010/0109392 | A1 * | 5/2010 | Toll | 297/202 |
| 2012/0299350 | A1 * | 11/2012 | Willingham | 297/284.2 |

* cited by examiner

SEAT FOR MOLDED PLASTIC CHAIRS

FIELD OF THE INVENTION

The invention relates particularly to molded plastic furniture, particularly chairs and stools having a hard surface seat.

BACKGROUND OF THE INVENTION

Molded plastic chairs are popular for use as outdoor furniture because they are not damaged by rain or snow. Molded plastic furniture is also light weight. Many molded plastic chairs are configured to be stackable so that several chairs can be stacked one upon the other for storage.

The seat in most molded plastic chairs is a flat or curved surface that may be horizontal or inclined. Because the surface is hard, many people become uncomfortable after being seated for a period of time. Depending on the person, that period of time may be less than five or ten minutes or as long as an hour. Many people will place cushions on the seats of molded plastic chairs to make them more comfortable.

Wooden chairs and indeed any chair which has a hard surface on the seat can be quite uncomfortable, particularly when the person must sit there for an extended period of time. Manufacturers have tried to make hard seats more comfortable by providing a contour in the seat surface. The contour or depression has been round or oval roughly corresponding to the outer surface of the buttocks of an average person who may sit on the seat. Indeed, some wooden seats used in classroom chairs have been shaped to make them more comfortable. Such shaping has generally involved providing a pair of spaced apart concave areas extending from the edge of the seat inward or an oval or round concave depression in the center of the seat.

When a person sits on a hard surface, the gluteus maximus and other muscles and tissues in the posterior are compressed. At the same time, blood vessels are compressed, adding to the discomfort. The objective in providing curved surfaces in seats is to increase the contact area between the seated person and the seat to spread the forces over a greater area. Prior to the present invention, that art has shaped those surfaces to generally correspond to the shape and position of the thighs and buttocks of the average person who may sit on that seat. Although these contour surfaces often make a hard seat more comfortable than a flat seat, even hard surfaced seats that have been made with curved surfaces tend to become uncomfortable. Consequently, there is a need for a seat having a hard surface that is formed in such a manner as to be more comfortable to the person seated on that seat.

SUMMARY OF THE INVENTION

We provide a seat, as well as a chair, a bench, and a stool having a seat, which is preferably made of molded plastic, but could also be made of wood or concrete or a hard composite material. The seat has a permanent depression in the surface of the seat that corresponds generally in shape to the lower protuberances of a human iliac bone. This shape has concave curved central channel which has a first end and a second end. There is a first concave boomerang shaped channel having a central portion connected to the first end of the concave curved central channel and a second concave boomerang shaped channel having a central portion connected to the second end of the concave curved central channel. A chair, stool or bench whose seat has such a permanent depression is more comfortable to the person sitting on that seat than hard seats on seating devices known in the art.

We may also provide a pair of depressions that extend from the central channel to the front edge of the seat and which depressions correspond to the rear surface of a human thigh. Depending upon the type of chair on which the seat is used and whether the seat is inclined or horizontal, the central channel may be centered relative to the front edge and the rear edge of the seat or be closer to the front edge or closer to the rear edge of the seat.

Other details and advantages of the invention will become apparent from a description of certain preferred embodiments shown in the drawings

DETAILED DESCRIPTION OF PREFERRED EMBODIMENTS OF THE INVENTION

Figure 1:
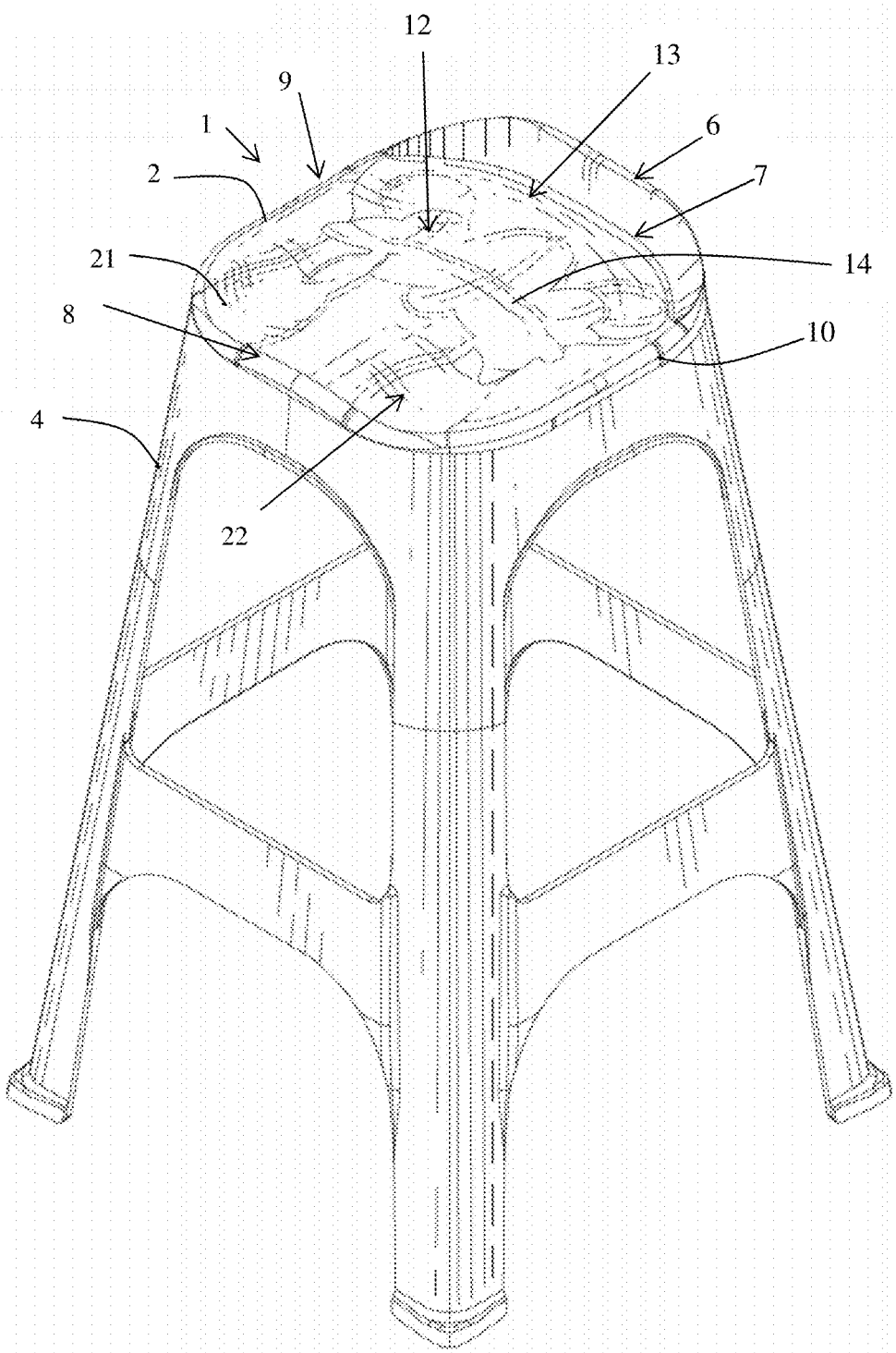
FIG. 1 is a perspective view of a first present preferred embodiment in the form of a stool having a seat which has a permanent depression in the surface of the seat that corresponds in shape to an end view of a human iliac bone.

Referring to FIGS. 1 through 6 we provide a stool 1 having a seat 2 and legs 4 that extend from the seat. In this embodiment the seat is generally square having rounded corners and a leg extends from each corner of the seat. However, the seat could be round, rectangular or oval and the stool may have three legs. This stool has a back 6 along the back edge 7 of the seat. The seat also has a front edge 8, a right edge 9 and a left edge 10. The stool is preferably made of a molded plastic such as polyvinyl chloride or polyethylene.

The seat 2 has a permanent depression 12 in the surface 13 of the seat that corresponds in shape to an end view of a human iliac bone. This shape has concave curved central channel 14, a first concave boomerang shaped channel 15 connected at its center to one end of the concave curved central channel and a second concave boomerang shaped channel 16 connected at its center to an opposite end of the concave curved central channel. The concave curved central channel and the two boomerang shaped channels form a bent dog bone shape. The concave curved central channel has a length of between 5 and 8 inches (12.7 to 20.3 cm.). The two boomerang shaped channels extend that length to between 9 and 12 inches (22.9 to 30.5 cm.). The concave curved central channel has a maximum depth which preferably does not exceed ⅝ inch (1.6 cm.). The bottom of the concave curved central channel 15 may be flat or slightly concave. Side walls extend upward from the base of the concave curved central channel. As can be seen most clearly in FIG. 2 through 6 these sidewalls curve toward the front edge or toward the rear edge of the seat. They also curve toward the right side or toward the left side of the seat. We also prefer to provide a pair of concave cavities 21, 22 one concave cavity extending from each of the boomerang shaped channels 15, 16 to the front edge 8 of the seat 12. These cavities 21 and 22 are shaped to correspond to a rear surface of a human thigh. The cavities are spaced apart from one another so that when an average adult person sits on the seat that person's thighs will be on the cavities. While we prefer to provide cavities 21 and 22, such cavities are not essential and may be omitted.

We have discovered that when a person sits on a hard surface several muscles are compressed. When the buttocks are sandwiched between a hard seating area and the prominent lower curve of the iliac bone protuberances (the lower part is the ischium), discomfort ensues to the overly compressed gluteus maximus muscles, the blood vessels within, and the skin. Pressure comes from both the hard seat and the ischium bones, increasingly cutting off circulation and compressing nerves as the pressure on the sitter's rear end continues to be maintained. By putting the right size and shape of depression in the chair seat, the maximum distance is maintained between the ischium and the seat surface. That configuration relieves pressure on the gluteus maximus muscles and the skin, making our new seat more comfortable.

Variations in human sizes were carefully considered. We designed the cavity to fit people between 4'11" and 6'3" comfortably. We made sure that the present design made the seat as comfortable as possible for sitters weighing between 95 and 240 pounds.

When a person sits on a chair, the two lowest protuberances of the iliac bone are pushed downward, toward the surface of the chair. The lower iliac protuberances press against the tissue between them and the actual seat. By providing a depression beneath each lower iliac protuberance, the compression of tissue between the lower iliac protuberance and the seating surface is minimized.

The seat design disclosed herein was developed based upon feedback from people ranging in size from 5' to over 6' tall. Various sizes and shapes of depressions were made and compared. The sizes that we have used in this application work best. Some rounding is necessary, and when the chair seat is angled backwards, as in an Adirondack chair, the cavities are deeper in the rear portion than in the front. That configuration lets the bone push above the depression that is beneath it, which has shifted to the rear depending on the slant of the chair and angle of the back.

The shape of the seat also takes into account the sensitive perineum area between the anus and the scrotum in males and between the anus and the vulva in females. When we provide the more comfortable cavity for the tissue beneath the iliac bone, the seat does not force the perineum area to absorb more pressure. The depressions in our seat minimize depression of the tissue below the lower iliac protuberances in a way that does not transfer more pressure to the perineum. Our seat has achieved maximum comfort to the sub-iliac area while relieving pressure to the perineum. In short, we eliminate pressure on the premium while reducing pressure to the maximum on the tissue below the lower iliac protuberances.

Some chairs use leather, webbing, or plastic straps to make the seat. When a person "sinks into" such a surface, the buttocks are forced together, making seating less comfortable. Such discomfort increases over time as the lower iliac protuberances compress the tissue beneath them. To make even these flexible seats more comfortable, a depression similar in size to that disclosed in this invention may be formed into the surface of such a seat. And, these depressions are also helpful in cushions, keeping the sub-iliac tissue and the nerves and blood vessels between those bones and chair surface from being needlessly compressed.

The depth and placement of the permanent depression should change from chair to chair, depending on the angle of the back. In the present embodiment of a stool shown in FIG. 1 *through* 6, the concave curved central channel 14 will be farther to the rear because the angle of the spine approximates 90 degrees. If such a permanent depression were to be put in an Adirondack chair, where the angle of the back to the thigh is greater than 90 degrees, the permanent depression may be shallower, and deeper in the back than in the front, as well as being moved slightly forward. Generally, the permanent depression should be centered relative to the right edge and the left edge of the seat. In every chair, the position of the permanent depression should be such that pressure from the ischium does not compress the gluteus maximus muscles, the skin, nerves, and blood vessels any more than absolutely necessary.

In commercial embodiments of the seat, there may be some rounding and changing of the shapes that provide maximum comfort to the tissue between the iliac bone's lower projections and the seating surface. While maximum comfort is important, the commercial embodiments may differ from the comfort ideal when it is thought more important to provide a cleaner, more attractive visual appearance.

If desired, one could provide a higher back and arms on the stool shown in FIG. 1. One arm would be above and adjacent the right edge of the chair and the second arm would be above and adjacent the left edge of the chair.

Figure 2:
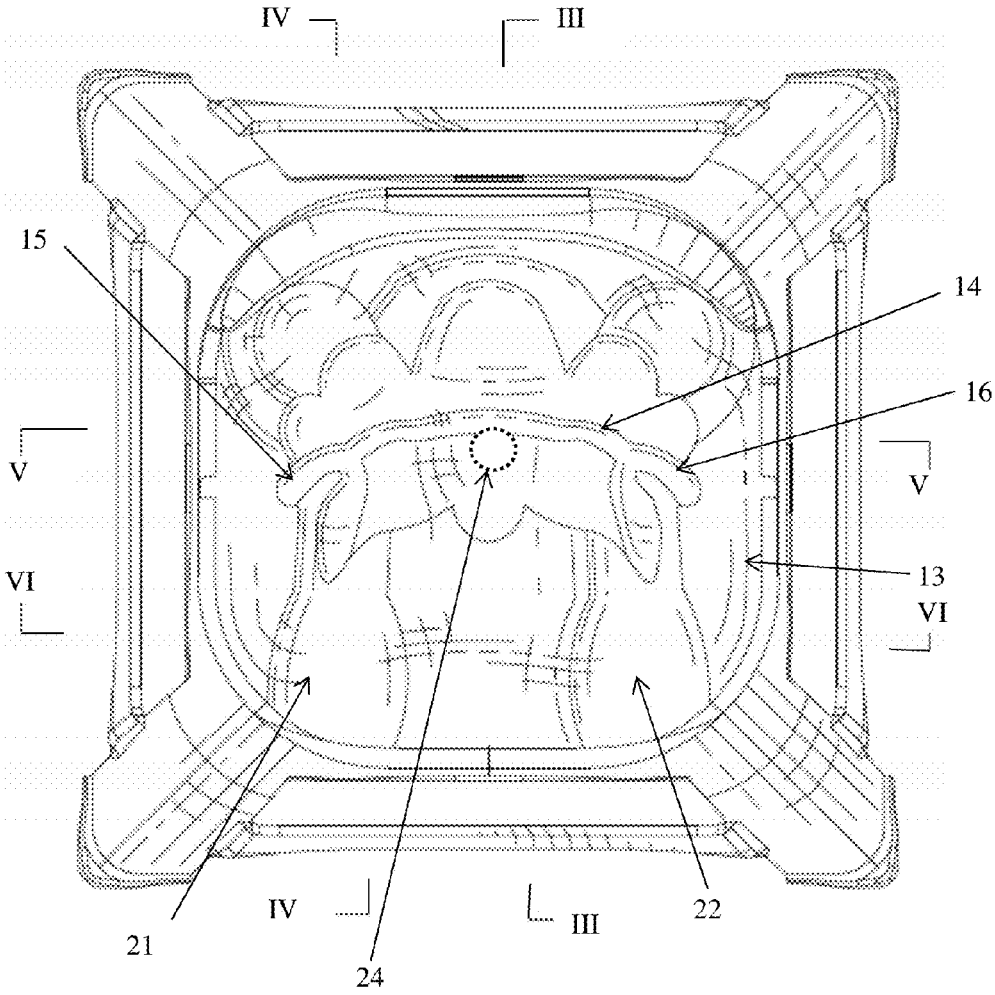
FIG. 2 is a top view of the stool shown in FIG. 1.
Figure 3:
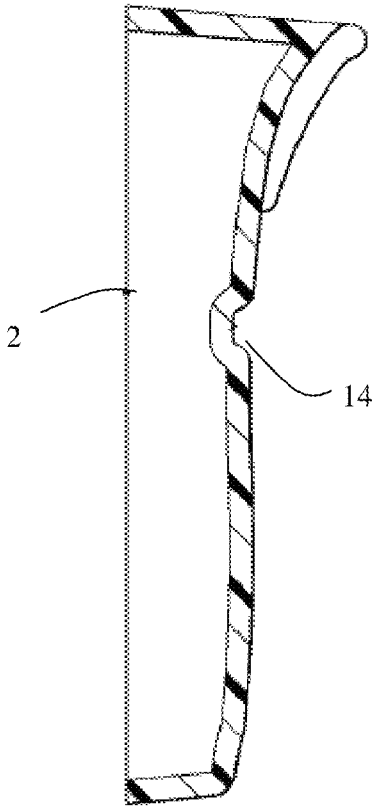
FIG. 3 is a sectional view taken along the line III-III in FIG. 2.
Figure 4:
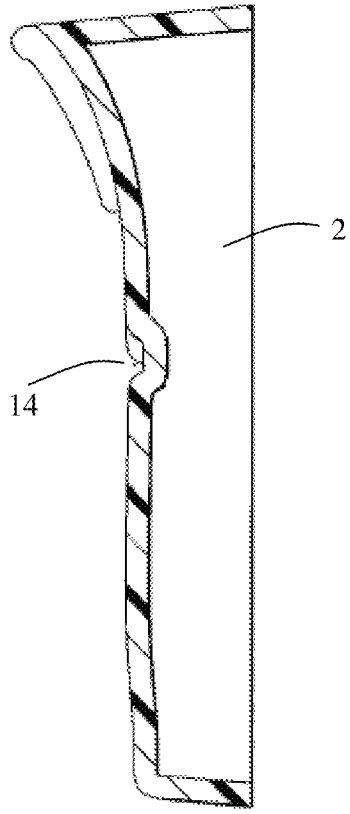
FIG. 4 is a sectional view taken along the line IV-IV in FIG. 2.
Figure 5:
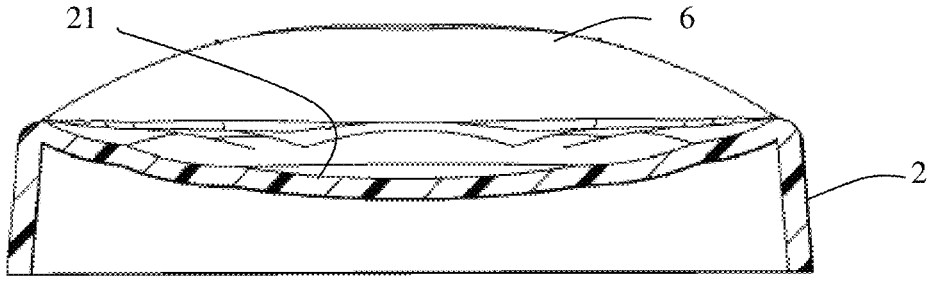
FIG. 5 is a sectional view taken along the line V-V in FIG. 2.
Figure 6:
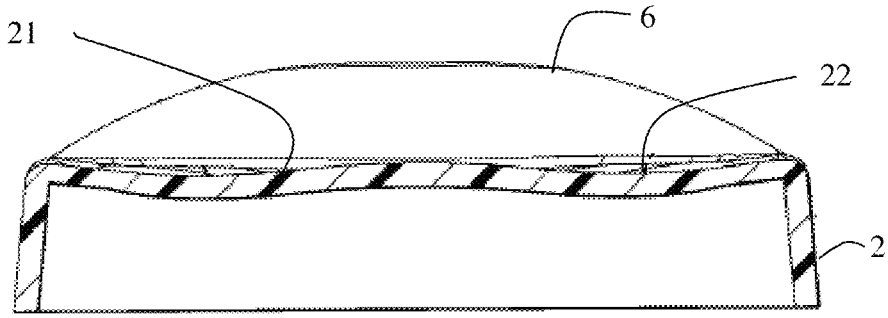
FIG. 6 is a sectional view taken along the line VI-VI in FIG. 2.

We may provide a hole 24 shown in dotted line in FIG. 2 in the top of the seat. This hole may be 1.5 inch (3.8 cm.) in diameter and allows water to drain from the permanent depression 12. The hole may enable a rotatable seat or a planter (not shown) to be held on the stool.

Figure 7:
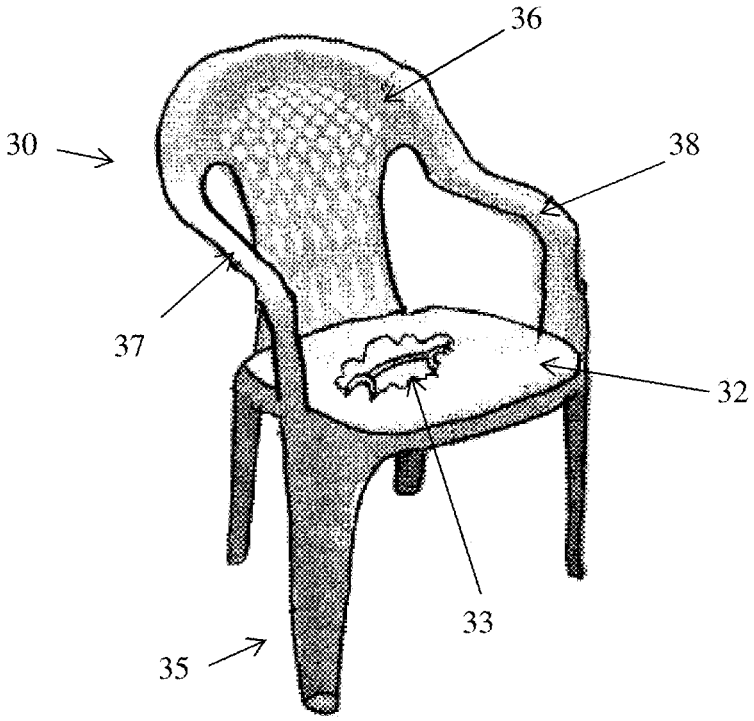
FIG. 7 is a perspective view of a second present preferred embodiment in the form of a chair having a seat which has a permanent depression in the surface of the seat that corresponds in shape to an end view of a human iliac bone.

Referring to FIG. 7 a second present preferred embodiment is in the form of a chair 30 having a seat 32 which has a permanent depression 33 in the surface of the seat 32 that corresponds in shape to an end view of a human iliac bone. This depression 33 is of the same size and shape as the permanent depression 12 in the embodiment of FIGS. 1 through 6. The chair has four legs 35 that extend from the seat and a back 36. An arm 37, 38 is provided above and adjacent the right edge and above and adjacent the left edge of the seat.

Figure 8:
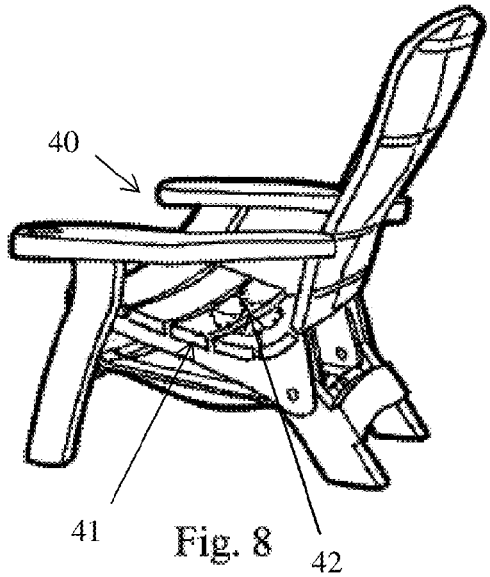
FIG. 8 is a perspective view of a third present preferred embodiment in the form of an Adirondack chair having a seat which has a permanent depression in the surface of the seat that corresponds in shape to an end view of a human iliac bone.

A third present preferred embodiment shown in FIG. 8 is the form of an Adirondack chair 40 having a seat 41 which has a permanent depression 42 in the surface of the seat 43 that corresponds in shape to an end view of a human iliac bone. This depression 42 is of the same size and shape as the permanent depression 12 in the embodiment if FIG. 1 through 6.

Figure 9:
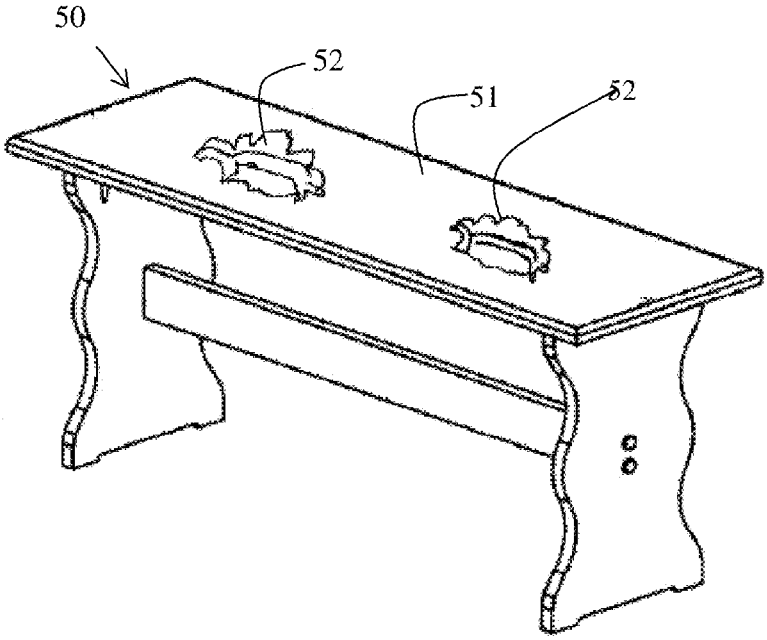
FIG. 9 is a perspective view of a fourth present preferred embodiment in the form of a bench having a seat which has a permanent depression in the surface of the seat that corresponds in shape to an end view of a human iliac bone.

Turning to FIG. 9 a fourth present preferred embodiment is in the form of a bench 50 that is sized for two people. The bench has a seat 51 which has a pair of permanent depressions 52 in the surface of the seat 51. These depressions 52 are of the same size and shape as the permanent depression 12 in the embodiment if FIG. 1 through 6. Longer benches can be made which have more than two permanent depressions 52, there being one permanent depression for each person for whom space is provided on the bench.

While we have shown and described certain present preferred embodiments of my seat for molded plastic furniture, it should be distinctly understood that the invention is not limited thereto but may be variously embodied in the scope of the following claims.

What is claimed is:

1. A seating device of the type having a front edge, a rear edge, a pair of opposite sides that extend from the front edge and a seat surface on which a person sits, the seat surface having a permanent depression which is spaced apart from the front edge, spaced apart from the rear edge and consists of a concave curved central channel, the channel having a first end and a second end, a first concave boomerang shaped channel having a central portion connected to the first end of the concave curved central channel and a second concave boomerang shaped channel having a central portion connected to the second end of the concave curved central channel.

2. The seating device of claim 1 wherein the seat surface is molded plastic.

3. The seating device of claim 1 wherein the central channel has a depth which is not greater than ⅝ inches.

4. The seating device of claim 1 wherein the central channel is centered on the seat surface.

5. The seating device of claim 1 wherein the central channel is closer to the front edge than to the back edge.

6. The seating device of claim 1 wherein the central channel is closer to the back edge than to the front edge.

7. The seating device of claim 1 wherein the central channel is centered relative to the side edges.

8. The seating device of claim 1 wherein the side edges are a right edge and a left edge and further comprising a right arm positioned above and adjacent to the right edge and a left arm positioned above and adjacent to the left edge.

* * * * *